US010595382B2

(12) United States Patent
Engelen et al.

(10) Patent No.: US 10,595,382 B2
(45) Date of Patent: Mar. 17, 2020

(54) METHOD AND SYSTEM FOR CONTROLLING A LIGHTING DEVICE

(71) Applicant: SIGNIFY HOLDING B.V., Eindhoven (NL)

(72) Inventors: Dirk Valentinus René Engelen, Heusden-Zolder (BE); Bartel Marinus Van De Sluis, Eindhoven (NL); Berent Willem Meerbeek, Veldhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 16/097,046

(22) PCT Filed: Apr. 18, 2017

(86) PCT No.: PCT/EP2017/059212
§ 371 (c)(1),
(2) Date: Oct. 26, 2018

(87) PCT Pub. No.: WO2017/186532
PCT Pub. Date: Nov. 2, 2017

(65) Prior Publication Data

US 2019/0159319 A1 May 23, 2019

(30) Foreign Application Priority Data

Apr. 26, 2016 (EP) ..... 16166958

(51) Int. Cl.
*H05B 33/08* (2006.01)
*H05B 37/02* (2006.01)

(52) U.S. Cl.
CPC ..... *H05B 37/0272* (2013.01); *H05B 33/086* (2013.01); *H05B 33/0863* (2013.01); *H05B 37/0245* (2013.01)

(58) Field of Classification Search
CPC ..... H05B 37/02; H05B 37/0227; H05B 37/0272; H05B 33/08; H05B 33/0842; H05B 33/086
See application file for complete search history.

(56) References Cited

U.S. PATENT DOCUMENTS 8,044,769 B2 * 10/2011 Diederiks ..... H05B 33/0863 340/12.5
2009/0315478 A1 12/2009 McColgin et al.
(Continued)

FOREIGN PATENT DOCUMENTS

WO 2006038135 A1 4/2006
WO 2006075297 A1 7/2006
(Continued)

*Primary Examiner* — Jimmy T Vu
(74) *Attorney, Agent, or Firm* — Akarsh P. Belagodu

(57) ABSTRACT

A method and a lighting system (100) for controlling a lighting device (112) are disclosed. The lighting system (100) comprises a first device (102) comprising a first (processor 104) for generating a signal (110) comprising information representative of associations between a plurality of orientations and a plurality of light settings, and a transmitter (106) for transmitting the signal (110). The lighting system (100) further comprises the lighting device comprising at least one light source (120), a receiver (116) for receiving the signal (110) from the first device (102), an orientation detector (118) for detecting a first orientation of the lighting device (112), and a second processor (114) for selecting a light setting associated with one of the plurality of orientations based on the first orientation, and for controlling the light output of the at least one light source (120) according to the light setting.

15 Claims, 7 Drawing Sheets

(56) References Cited

U.S. PATENT DOCUMENTS

| | | | | |
|---|---|---|---|---|
| 2015/0102732 | A1 | 4/2015 | Engelen et al. | |
| 2015/0216008 | A1 | 7/2015 | Van De Sluis et al. | |
| 2015/0345762 | A1 | 12/2015 | Creasman et al. | |
| 2017/0278383 | A1 * | 9/2017 | Dimberg | G01D 5/02 |

FOREIGN PATENT DOCUMENTS

| | | | |
|---|---|---|---|
| WO | 2012113036 | A1 | 8/2012 |
| WO | 2015128771 | A1 | 9/2015 |

* cited by examiner

METHOD AND SYSTEM FOR CONTROLLING A LIGHTING DEVICE

CROSS-REFERENCE TO PRIOR APPLICATIONS

This application is the U.S. National Phase application under 35 U.S.C. § 371 of International Application No. PCT/EP2017/059212, filed on Apr. 18, 2017, which claims the benefit of European Patent Application No. 16166958.5, filed on Apr. 26, 2016. These applications are hereby incorporated by reference herein.

FIELD OF THE INVENTION

The invention relates to a method of controlling a lighting device. The invention further relates to a lighting system for controlling a lighting device. The invention further relates to a lighting device.

BACKGROUND

Future and current home and professional environments will contain a large number of lighting devices for creation of ambient, atmosphere, accent or task lighting. These lighting devices may be controlled via a (wireless) network, for example by a smart device such as a smartphone, or via switches or control panels. Other types of lighting control require physical interaction with the controllable lighting device. An example of a lighting device that may be controlled via physical interaction is disclosed in patent application WO2006038135A1, wherein the light emission of a portable lighting device is based on the orientation of the lighting device.

The increase of smart lighting devices in home and professional environments enable scene setting (i.e. controlling one or more lighting devices such that they create a consistent light effect, for example an evening light effect, an office light effect, a party light effect, etc.). In current systems, a user may select these scenes via a user interface of a smart device, a switch or a lighting control panel. In such systems, the one or more lighting devices are controlled according to preset light settings, not taking into account how these effects influence the environment, thereby possibly creating light scenes (effects) which are not in line with the user's expectations. Thus, there is a need in the art that light scenes are applied to one or more lighting devices automatically in such a way that they convey the light effect in a befitting manner.

International patent application WO 2006/075297 A1 relates to a lighting system that comprises: a plurality of remote-controlled lighting devices, each including a support which can be oriented around a pair of axes, a plurality of light sources carried by the support and motor means for controlling the orientation of the support around the pair of axes; and a remote control system including programming means for programming a number of lighting configurations, for each of which the orientation of the support and the intensity of the light emitted by each light source of each lighting device are set, storing means for storing the number of programmed lighting configurations; and selecting means for calling up any one of the stored lighting configurations.

SUMMARY OF THE INVENTION

It is an object of the present invention to provide a lighting system that controls one or more lighting devices such that they complement a light scene in a befitting manner. It is a further object of the present invention to enable a user to adjust the light output of the one or more lighting devices in an intuitive way.

According to a first aspect of the present invention, the object is achieved by a method of controlling a lighting device, the method comprising:

generating, by a first device, a signal comprising information representative of associations between a plurality of orientations and a plurality of light settings, transmitting the signal, receiving, by the lighting device, the signal, detecting a first orientation of the lighting device, selecting a light setting associated with one of the plurality of orientations based on the first orientation, and controlling the lighting device according to the selected light setting.

The first device generates a signal comprising information representative of associations between a plurality of orientations and a plurality of light settings. This enables the first device to determine a light scene, which light scene is defined by the plurality of light settings (e.g. lighting control instructions for controlling the color, intensity or saturation of the light output of the lighting device), which may be applied by one or more lighting devices. A lighting device may receive the signal, whereupon it compares its orientation (the first orientation) to the plurality of orientations comprised in the information comprised in the signal to determine if a similarity criterion (e.g. a threshold value) between the orientation of the lighting device and one of the plurality of orientations is met. If the similarity criterion has been met, a light setting associated with the one of the plurality of orientations is selected. After the light setting has been selected, the light output of the lighting device is controlled according to the selected light setting. As such, the lighting device is controlled such that it complements the light scene (which has been determined by the first device) in a befitting manner.

In an embodiment of the method, the method further comprises the steps of:

detecting a user input indicative of a reorientation of the lighting device, detecting a second orientation of the lighting device, selecting a second light setting associated with one of the plurality of orientations based on the second orientation, and controlling the lighting device according to the selected second light setting.

A user may provide a user input to reorient the lighting device, whereupon a new orientation (i.e. the second orientation) is detected. Upon detecting the new orientation, the new orientation is compared to the plurality of orientations comprised in the information comprised in the signal to determine if a similarity criterion (e.g. a threshold value) between the new orientation of the lighting device and one of the plurality of orientations is met. If the similarity criterion has been met, a second light setting associated with the one of the plurality of orientations is selected. After the second light setting has been selected, the light output of the lighting device is controlled according to the selected light setting. This is beneficial, because it enables a user to reorient the lighting device to select a light output which complements the light scene (which has been determined by the first device) in a befitting manner.

In an embodiment of the method, the associations between the plurality of orientations and the plurality of light settings are based on an orientation of the first device. In this embodiment, the first device determines the associations between the plurality of orientations and the plurality of settings, which are comprised in the signal, based on its own orientation. As such, the light scene is determined by the first device (and based on the orientation of the first device). This is beneficial, because it allows a user to orient the first device (e.g. a smart device or a lighting device) to select/set the light scene.

In an embodiment of the method, the associations between the plurality of orientations and the plurality of light settings are based on a light output of the first device. In this embodiment, the first device (e.g. a lighting device) comprises a light source arranged for emitting a light output. The first device determines the associations between the plurality of orientations and the plurality of settings, which are comprised in the signal, based on its own light output. As such, the light scene is determined by the first device (and based on the light output of the first device). This is beneficial, because it allows the first device to generate a light scene (i.e. the plurality of settings) which complements the current light output of the first device.

In an embodiment of the method, the method further comprises receiving a location signal indicative of a current location of the lighting device, and the selection of the light setting is further based on the current location of the lighting device. This embodiment enables the lighting device to determine its light output further based on its location (which may be relative to a space, relative to the first device, relative to a further lighting device, etc.). Determining which light setting is most suitable for a specific location is beneficial, because it enables the lighting device to further complement the light scene.

In an embodiment of the method, the selection of the light setting is further based on a type of the lighting device. Different types of lighting devices complement light scenes in different ways. An LED strip installed underneath a cabinet, for example, may provide indirect light, while a TLED (tubular LED) installed in the ceiling may provide directional light, whereas a light bulb may provide omnidirectional light. As such, it is beneficial to determine the light output (the light setting) of the lighting device based on its type, because it enables the lighting device to further complement the light scene.

In an embodiment of the method, the method further comprises receiving a light setting signal indicative of a current light setting of a further lighting device, and the selection of the light setting is further based on the current light setting of the further lighting device. This embodiment enables the lighting device to determine its light output further based on the light output of the further lighting device, and thereby complement the light setting of the further lighting device. Additionally, the method may further comprises receiving a second location signal indicative of a second location of the further lighting device, wherein the selection of the light setting is further based on the second location of the further device. This embodiment enables the lighting device to determine its light output further based on the location of the further lighting device, and thereby complement the light setting of the further lighting device.

According to a second aspect of the present invention, the object is achieved by a lighting system for controlling a lighting device, the lighting system comprising: a first device comprising a first processor for generating a signal comprising information representative of associations between a plurality of orientations and a plurality of light settings, and a transmitter for transmitting the signal, and the lighting device comprising:

at least one light source, a receiver for receiving the signal from the first device, an orientation detector for detecting a first orientation of the lighting device, and a second processor for selecting a light setting associated with one of the plurality of orientations based on the first orientation, and for controlling the light output of the at least one light source according to the light setting.

It should be understood that the claimed lighting system may have similar and/or identical embodiments and advantages as the claimed method.

According to a third aspect of the present invention, the object is achieved by a lighting device comprising:

at least one light source, an orientation detector for detecting a current orientation of the lighting device, a receiver for receiving input signals from further lighting devices, a transmitter for transmitting output signals to further lighting devices, and a processor for setting the lighting device to a master mode and/or a slave mode, wherein, when the lighting device has been set to the master mode, the processor is arranged for controlling the light output of the at least one light source based on the current orientation, and for generating an output signal comprising information representative of associations between a plurality of orientations and a plurality of light settings based on the current orientation, and wherein, when the lighting device has been set to the slave mode, the processor is arranged for selecting, based on the current orientation, a light setting from the input signal, which input signal comprises information representative of associations between a plurality of orientations and a plurality of light settings, and for controlling the light output of the at least one light source according to the selected light setting.

The lighting device may be used in any lighting system according to the lighting systems of the appended claims. The processor of the is able to switch the operational mode of the lighting device between a master mode and a slave mode. In the master mode, the light scene that may be communicated to further lighting devices is determined based on the orientation of the lighting device, and the lighting device's light output is controlled based on its own orientation. In the slave mode, the light output of the lighting device is based on its orientation and on a light scene received from a further lighting device. This dual functionality is beneficial, because it enables a user to install a plurality of such lighting devices in a lighting system, assign a master role to one lighting device, whereupon the light output of all other lighting devices is controlled according to their respective orientations and the light scene generated by the master lighting device. This further enables a user to change the orientation of slave lighting devices such that their light output is controlled according to the new orientation, while the slave devices still complement the light scene as defined by the master lighting device. Furthermore, this enables a user to select a light scene by reorienting the master lighting device, which light scene (i.e. the signal comprising the associations between the plurality of orientations and light settings) is then applied by the slave devices according to their respective orientations. Another benefit of this lighting device is that a user can assign the master role from a first lighting device to a second lighting device, whereupon the second lighting device becomes the 'user interface' for setting/selecting the light scene.

It should be understood that the claimed lighting device may have similar and/or identical embodiments and advantages as the claimed method.

BRIEF DESCRIPTION OF THE DRAWINGS

The above, as well as additional objects, features and advantages of the disclosed methods, systems and devices, will be better understood through the following illustrative and non-limiting detailed description of embodiments of systems, devices and methods, with reference to the appended drawings, in which.

All the figures are schematic, not necessarily to scale, and generally only show parts which are necessary in order to elucidate the invention, wherein other parts may be omitted or merely suggested.

DETAILED DESCRIPTION OF EMBODIMENTS

Figure 1:
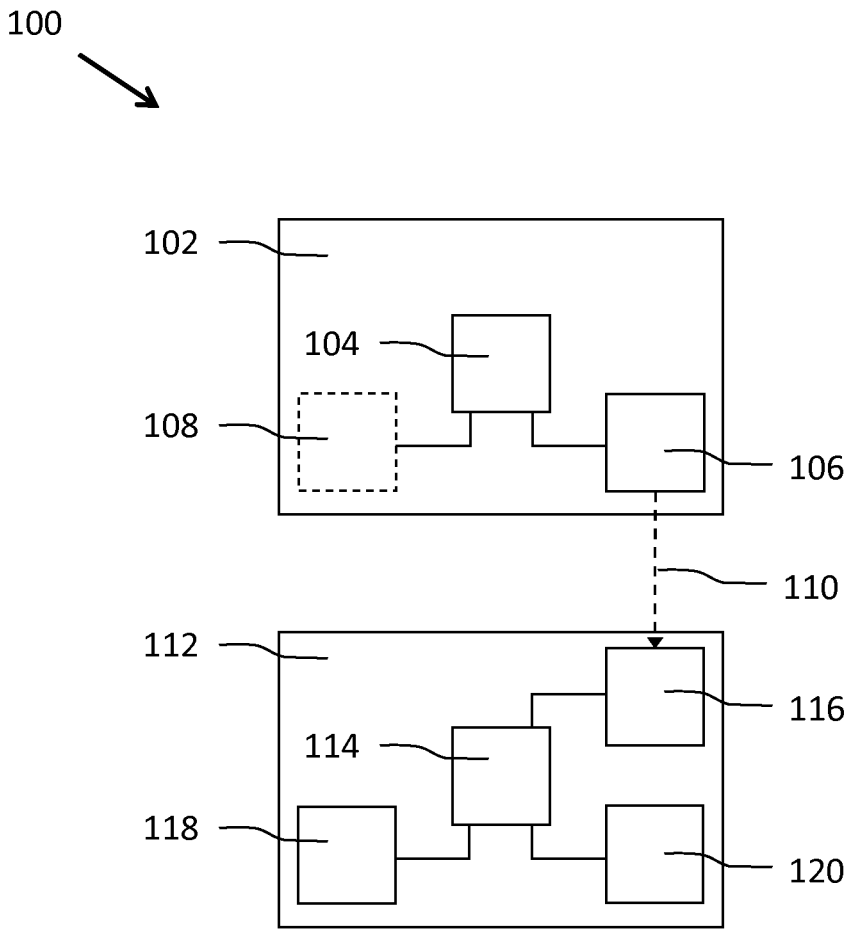
FIG. 1 shows schematically an embodiment of a lighting system according to the invention for controlling a lighting device.

FIG. 1 shows schematically an embodiment of a lighting system 100 according to the invention for controlling a lighting device 112. The lighting system 100 comprises a first device 102 comprising a first processor 104 for generating a signal 110 comprising information representative of associations between a plurality of orientations and a plurality of light settings, and a transmitter 106 for transmitting the signal 110. The lighting system 100 further comprises the lighting device comprising at least one light source 120, a receiver 116 for receiving the signal 110 from the first device 102, an orientation detector 118 for detecting a first orientation of the lighting device 112, and a second processor 114 for selecting a light setting associated with one of the plurality of orientations based on the first orientation, and for controlling the light output of the at least one light source 120 according to the light setting. The first device 102 generates the signal 110 comprising information representative of associations between a plurality of orientations and a plurality of light settings. This enables the first processor 104 of the first device 102 to determine a light scene, which light scene is defined by the plurality of light settings (e.g. lighting control instructions for controlling the color, intensity or saturation of the light output of the lighting device), one of which may be applied to the lighting device 112. The receiver 116 of the lighting device 112 may receive the signal 110, and the orientation detector 118 may detect the orientation of the lighting device 112, whereupon the second processor 114 compares its orientation (the first orientation) to the plurality of orientations comprised in the information comprised in the signal 110 to determine if a similarity criterion (e.g. a threshold value) between the orientation of the lighting device 112 and one of the plurality of orientations is met. If the similarity criterion has been met, a light setting associated with the one of the plurality of orientations is selected. After the light setting has been selected, the second processor 114 controls the light output of the lighting device 112 according to the selected light setting. As such, the lighting device is controlled such that it complements the light scene (which has been determined by the first device). This enables a user to select a light scene (for example a 'work' setting comprising a variety of white and blue light settings) at the first device 102, for example a smartphone. The smartphone may communicate the signal, which comprises associations between the plurality of orientations and the plurality of light settings, to one or more lighting devices 112. The signal may, for example, be received by a first lighting device, for example a downward-facing desk lamp, whereupon the light output of the desk lamp is controlled according to a light setting from the light scene associated with the current orientation of the desk lamp (e.g. a bright white light illuminating the table surface). The user may then reorient the desk lamp (for example by reorienting it towards the ceiling), whereupon the light output of the desk lamp is controlled according to a light setting from the light scene associated with the new orientation of the desk lamp (e.g. a blue light). As such, the user can control the light output of the lighting device 112 within the limits of the light scene (i.e. the plurality of light settings).

The first device 102 may be any type of device comprising a processor 104 (e.g. a microchip, circuitry, a microprocessor, etc.) arranged for generating the signal 110. The first device 102 may, for example, be a device such as a smart phone or a (tablet) pc, a wearable device such as a smart watch, a smart goggles, a lighting device, etc. The first device 102 further comprises the transmitter 106 for transmitting the signal 110 to the lighting device 112. The transmitter 106 may comprise hardware for transmitting the signal 110 via any wired or wireless communication protocol. The receiver 116 of the lighting device may comprise hardware for receiving the signal 110 via any wired or wireless communication protocol. Various wired and wireless communication protocols may be used, for example Ethernet, DMX, DALI, USB, Bluetooth, Wi-Fi, Li-Fi, 3G, 4G or ZigBee. A specific communication technology may be selected based on the communication capabilities of the first device 102 or the communication capabilities of the lighting device 112, the power consumption of the communication driver for the (wireless) communication technology and/or the communication range of the signals.

The signal 110, which is transmitted by the first device 102, is generated by the processor 104 and comprises information representative of associations between a plurality of orientations and a plurality of light settings. Light settings may comprise information of lighting control settings for the plurality of lighting devices (a light setting may, for example, comprise instructions to set the lighting device 112 to a specific color, intensity and/or saturation). The signal may comprise a lookup table which comprises these associations. Table 1 illustrates an example of such a lookup table. In table 1, the light settings are represented as RGBI (red, green, blue, intensity) values, but it should be noted that any light/color scheme may be used for communicating the light settings to the lighting device.

The lighting device 112 comprises at least one light source 120 arranged for being controlled by the processor 114. The at least one lighting source may be any type of light source arranged for providing a light output. Examples include but are not limited to an LED light source, an OLED light source, an incandescent light source, a fluorescent light source, a high-intensity discharge light source, etc. The lighting device 112 may be arranged for providing general lighting, task lighting, ambient lighting, atmosphere lighting, accent lighting, indoor lighting, outdoor lighting, etc. The lighting device 112 may be installed in a luminaire or in a lighting fixture, may be a standalone lighting device such as an LED strip, may be a portable lighting device (e.g. a hand-sized device, such as an LED cube, an LED sphere, an object/animal shaped lighting device, etc.) or a wearable lighting device (e.g. a light bracelet, a light necklace, etc.).

The lighting device 112 further comprises the orientation detector 118. The orientation detector 112 may comprise an orientation sensor such as a gyroscope, a magnetometer, a tilt sensor, etc. in order to determine the orientation of the lighting device 112. The orientation of the lighting device 112 may be defined by the roll, pitch and yaw of the lighting device 112 around the X, Y and Z axes. Alternatively, the orientation sensor may be able to determine a location of a gravity vector compared to a reference gravity vector in order to provide a value that represents the orientation. Upon detecting the orientation of the lighting device 112, the orientation detector 118 may generate an orientation signal in order to communicate the orientation to the processor 114. The processor 114 may compare its orientation to the plurality of orientations comprised in the signal to determine if a similarity criterion between its orientation and one of the plurality of orientations is met. If the similarity criterion has been met, a light setting associated with the one of the plurality of orientations is selected. After the light setting has been selected, the light output of the lighting device is controlled according to the selected light setting.

TABLE 1

| | Orientation | Light setting |
|---|---|---|
| 1 | (X, Y, Z) = (0, 180, 0) | (R, G, B, I) = (255, 0, 0, 34) |
| 2 | (X, Y, Z) = (0, 0, 0) | (R, G, B, I) = (127, 86, 214, 62) |
| 3 | (X, Y, Z) = (45, 180, 45) | (R, G, B, I) = (255, 255, 255, 255) |
| 4 | (X, Y, Z) = (0, 90, 0) | (R, G, B, I) = (255, 32, 175, 34) |
| 5 | (X, Y, Z) = (0, 90, 180) | (R, G, B, I) = (27, 180, 120, 46) |

In an exemplary embodiment the processor 114 of the lighting device 112 receives a signal 110 comprising the associations of Table 1, which are used to determine which light setting is associated with the lighting device's 112 orientation. In this example, the detector may detect an orientation (0, 88, 170) (which is representative of a 0° rotation around the X axis, an 88° rotation around the Y axis and a 170° rotation around the Z axis), and, based on a similarity criterion (e.g. a 10% deviation range) determine that sufficient similarities with orientation 5 (0, 90, 180) are present. The processor 112 may therefore control the light output of the lighting device according to light setting 5 (27, 180, 120, 46) (R, G, B and I describe the red, green, blue and light intensity values of the light setting on a scale from 0-255).

Figure 2:
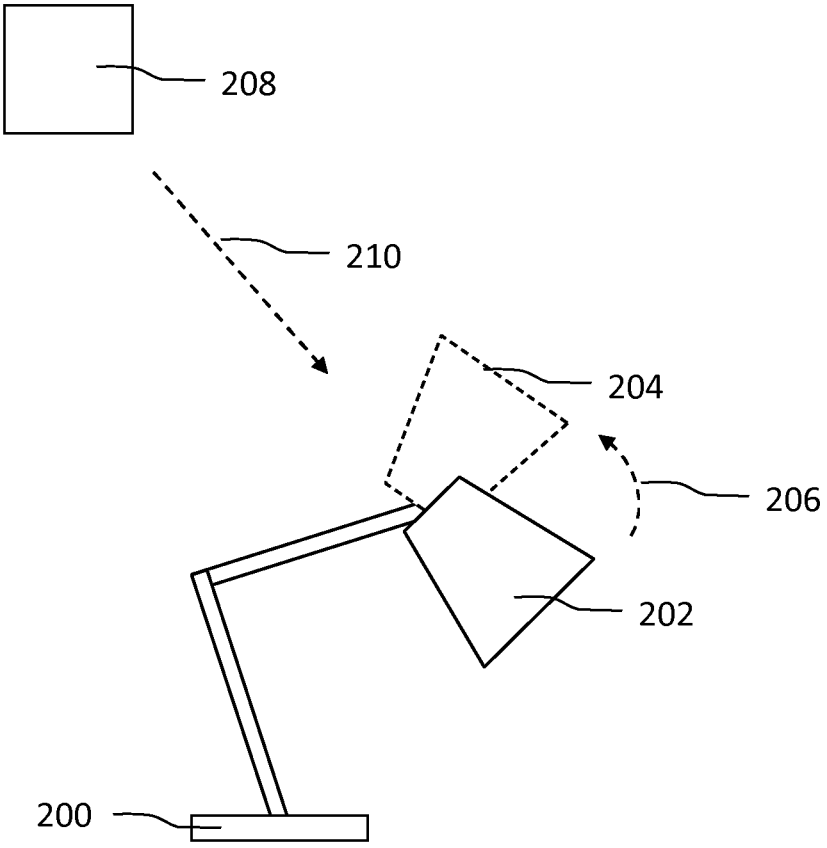
FIG. 2 shows schematically an embodiment of a lighting system according to the invention for controlling a lighting device according to first and second orientations.

The lighting device 112 may be arranged for receiving a user input indicative of a reorientation of the lighting device 112. Upon reorienting the lighting device 112, the orientation detector 118 may detect a second orientation of the lighting device 112. Upon receiving the second orientation from the orientation detector 118, the second processor 114 may select a second light setting associated with one of the plurality of orientations based on the second orientation, whereupon the second processor 114 may control the light output of the at least one light source 120 according to the selected second light setting. FIG. 2 illustrates an example of a reorientation 206 of a lighting device 200. In this example, the lighting device 200 is a desk lamp comprising a receiver (not shown) for receiving the signal 210 from the first device 208 (for example a smartphone), an orientation sensor (not shown) comprised in the lamp shade 202 and a second processor (not shown). A user may reorient the lamp shade 202 (and therewith the orientation sensor) from a first position 202 to a second position 204. Upon detecting the reorientation, the second processor may control the light output of the lighting device 200 according to a light setting associated with the second orientation 204.

The first device 102 may comprise a user interface for receiving a user input related to a selection of a light scene. The first device may comprise any type of user interface arranged for receiving the first and the second user input. The user interface may for example comprise a touch-sensitive device such as a touchpad, a touchscreen, one or more buttons and/or one or more sliders for receiving touch input. The user interface may be coupled to the processor 104, which may generate the signal 110 based on the selected light scene. A user may, for example, select an icon of a 'sunset' light scene, whereupon the processor 104 generates the signal, which signal comprises associations between orientations and light settings (for example: an upward orientation may be associated with a dark blue light setting, while a downward orientation may be associated with an orange light setting).

Figure 3:
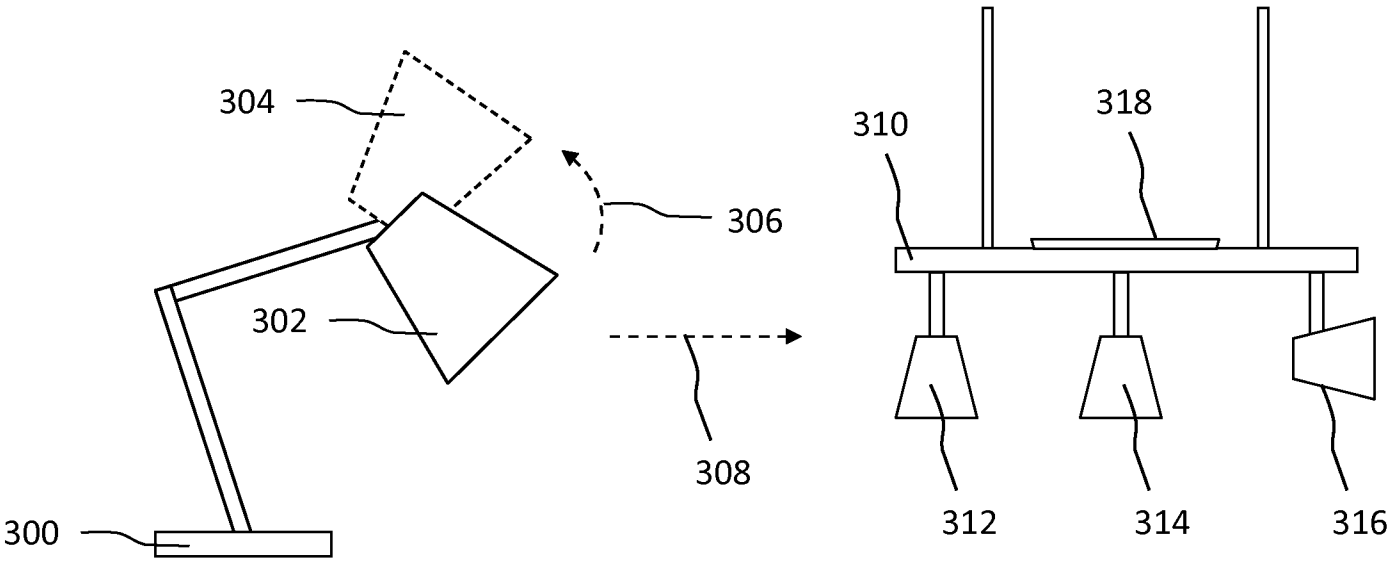
FIG. 3 shows schematically an embodiment of a lighting system according to the invention for controlling a lighting device, wherein the lighting device is controlled based on the orientation of another lighting device.

The first device 102 may comprise a second orientation detector 108 for detecting a second orientation of the first device 102. The first processor 104 of the first device 102 may be further arranged for generating the light scene (i.e. the signal comprising information representative of associations between a plurality of orientations and a plurality of light settings) based on the second orientation of the first device 102. This enables a user to select the light scene for the lighting device 112 by reorienting the first device 102. The first device may, for example, be a lighting device. FIG. 3 illustrates an example of a lighting system comprising a first lighting device 300 and a plurality of second lighting devices 312, 314, 316, 318 comprised in chandelier 310. The first processor (not shown) of the desk lamp 300 may receive information indicative of the orientation of the lighting device 302 and generate the signal 308 based on the orientation. The lighting device 302 may, for example, be directed downward (which may be indicative of an 'office' light setting), whereupon the first processor generates a signal (a light scene) comprising a first association between a downward orientation and a white light setting, a second association between an upward orientation and a colored (e.g. orange) light setting, and a third association between a horizontal orientation and an 'off' light setting (i.e. light with zero brightness). Based on this signal 308, downward facing lighting devices 312 and 314 may be controlled according to the white light setting (to provide task lighting), upward facing lighting device 318 may be controlled according to the colored light setting (to provide ambient lighting), while horizontally oriented lighting device 316 may be turned off (to reduce the chance of glare). Optionally, a user may reorient lighting devices 312, 314, 316 and/or 318 in order to change their light outputs according to the light scene. A user may reorient 306 lighting device 302 from orientation 302 to orientation 304, whereupon the first processor (not shown) of the first desk lamp 300 may receive information indicative of the reorientation of the lighting device 302 and generate a new signal 308 based on the new orientation 304. With new orientation 304 the lighting device is directed upward (which may be indicative of an 'ambient' light setting), whereupon the first processor generates a signal (a light scene) comprising a first association between a downward orientation and an 'off' light setting, a second association between an upward orientation and a colored (e.g. orange) light setting with a high brightness, and a third association between a horizontal orientation and an colored (e.g. red) light setting with a low brightness. Based on this new signal 308, downward facing lighting devices 312 and 314 may be turned off, upward facing lighting device 318 may be controlled according to the colored light setting with a high intensity (to provide ambient lighting), while horizontally oriented lighting device 316 may be controlled according to the colored light setting with a low intensity (to provide ambient lighting).

Additionally or alternatively, the first processor 104 of the first device 102 may be further arranged for generating the light scene (i.e. the signal comprising information representative of associations between a plurality of orientations and a plurality of light settings) based on the light output of the first device 102. Again referring to FIG. 3, the first processor (not shown) of the desk lamp 300 may receive information indicative of the current light output of the lighting device 302 and generate the signal 308 based on the current light output. The lighting device 302 may, for example, emit white light, whereupon the first processor generates a signal (a light scene) comprising a first association between a downward orientation and a white light setting, a second association between an upward orientation and a red light setting, and a third association between a horizontal orientation and an yellow light setting. Based on this signal 308, downward facing lighting devices 312 and 314 may be controlled according to the white light setting, upward facing lighting device 318 may be controlled according to the red light setting, and horizontally oriented lighting device 316 may be controlled according to the orange light setting. A user may change the light output of lighting device 302, for example by providing a user input at the lighting device 302 (e.g. by pressing a switch, by providing a touch input on a touch sensitive surface of the lighting device 302, etc.), or by providing a user input at a smart device connected to the lighting device 302. The user may for example select a warm yellow light output for the lighting device 302, whereupon the first processor (not shown) of the first desk lamp 300 may generate a new signal 308 based on the new light output, the new signal (light scene) comprising a first association between a downward orientation and a warm yellow light setting with a low brightness, a second association between an upward orientation and a warm yellow light setting with a high brightness, and a third association between a horizontal orientation and a warm yellow light setting with a medium brightness. Based on this new signal 308, lighting devices 312, 314, 316 and 318 are controlled accordingly. This provides the advantage that lighting devices 312, 314, 316 and 318 are controlled such that they complement the light output of lighting device 302.

The second processor 114 may be further arranged for receiving a light setting signal indicative of a current light setting of a further lighting device (not shown). The second processor 114 may be further arranged for selecting the light setting from the plurality of light settings received from the first device 102 based on the light setting of the further device. The light setting signal may be received via the receiver (for example via any of the above-mentioned communication protocols) or via any other receiving means. This may be advantageous, because it may be required for specific light scenes that either two lighting devices emit the same light output, or that two lighting devices emit different light outputs.

The second processor 114 may be further arranged for receiving a location signal indicative of a current location of the lighting device 112, and for selecting the light setting further based on the current location of the lighting device 112. The lighting device 112 may comprise a location sensor for determining its location. The location of the lighting device 112 may be relative to the space wherein the lighting device 112 is located, or it may be relative to the location of one or more further lighting devices located in the space. The lighting system 100 may further comprise a positioning system in order to determine the location of the lighting device 112 and, optionally, of the first device 102 or of a further lighting device. An example of such a positioning system is an (indoor) positioning system that uses a plurality of radio frequency (RF) beacons distributed throughout the space that may communicate with the lighting device 112. The location sensor may for example be an RF transceiver arranged for transmitting and/or receiving RF signals to/from the beacons. The positioning system may use triangulation or trilateration to calculate the position of the lighting device 112 relative to the position of the beacons based on for example the time-of-flight (TOF) of the RF signals received from the beacons, or based on the received signal strength of the RF signals received from the beacons.

Figure 4:
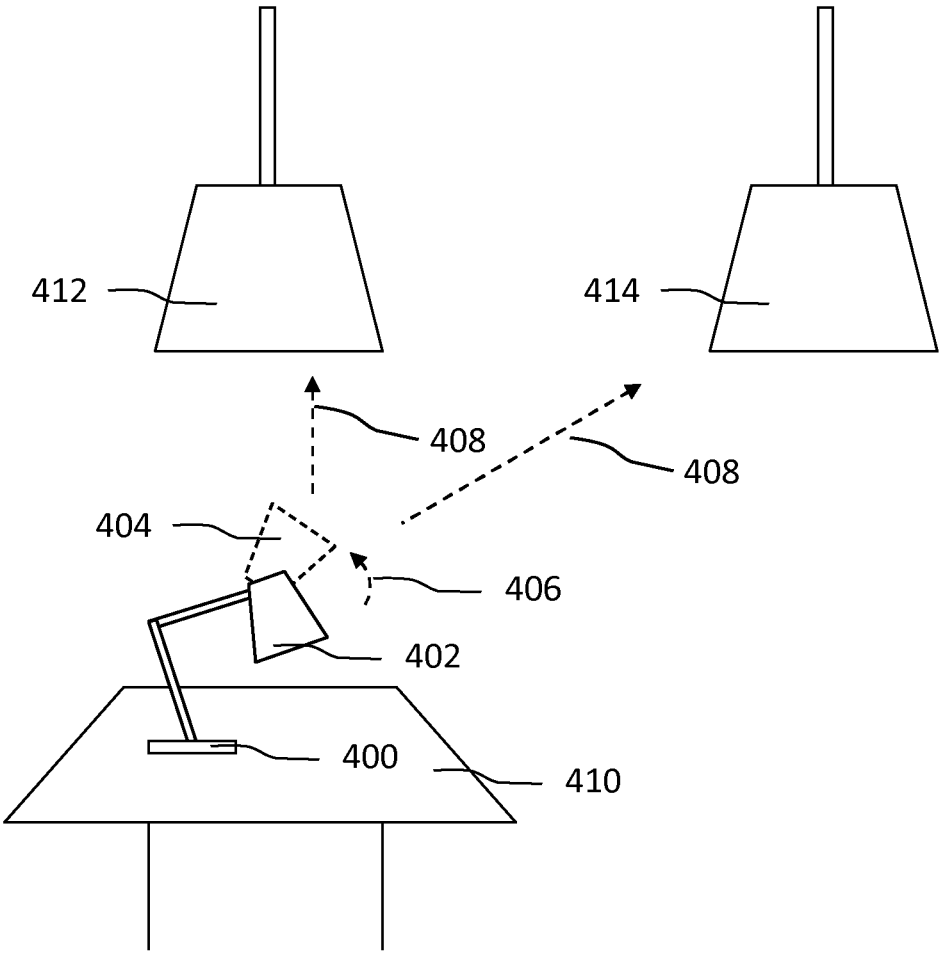
FIG. 4 shows schematically an embodiment of a lighting system according to the invention for controlling a lighting device, wherein the lighting device is controlled based on its location and its orientation.

FIG. 4 illustrates an example of a lighting system comprising a first device 400, a first lighting device 412 and a second lighting device 414. The first 412 and second 414 lighting devices may comprise second processors (not shown) for receiving location signals indicative of their current locations relative to the space or relative to the first device 400. The first processor (not shown) of the first device 400 may be arranged for generating the signal, wherein the signal further comprises a plurality of associations between (relative or absolute) locations and light settings. The second processors of the lighting devices 412, 414 may compare their location to the plurality of locations comprised in the signal to determine if a similarity criterion between their location and one of the plurality of locations is met. If the similarity criterion is met, a light setting associated with the one of the plurality of location is selected. After the light setting has been selected, the light output of the lighting device is controlled according to the selected light setting. This enables the first device 400 to generate a light scene which is applied by receiving lighting devices 412, 414, which light scene is not only based on the orientation of the lighting devices 412, 414, but also based on their location.

The first processor (not shown) of the desk lamp 400 may receive information indicative of the orientation and location of the lighting device 402 and generate the signal 408 based on the orientation. The lighting device 402 may, for example, be directed downward (which may be indicative of an 'office' light setting), whereupon the first processor generates a signal 408 (a light scene) comprising a first association between a downward orientation, a first location and a white light setting and a second association between a downward orientation, a second location and an 'off' light setting. The generation of the associations may be further based on the location of the first device 400. Based on this signal 408, downward facing lighting device 412 may be controlled according to the white light setting (to provide task lighting) because it is located at the first location, and downward facing lighting device 414 may be controlled according to the 'off' light setting because it is located at the second location (e.g. to prevent reflections of the light source of lighting device 414 when it illuminates, for example, a laptop located at the first device 410). Optionally, a user may reorient lighting devices 412 and 414 in order to change their light outputs according to the light scene. A user may reorient 406 lighting device 402 from orientation 402 to orientation 404, whereupon the first processor generates a new signal 408 (a light scene) comprising a first association between a downward orientation, a first location and a low brightness light setting and a second association between a downward orientation, a second location and an medium brightness light setting. The generation of the associations may be further based on the location of the first device 400. Based on this new signal 408, downward facing lighting device 412 may be controlled according to the low light setting because it is located at the first location (it is located nearby the first device 400 it is not required to provide a bright output), and downward facing lighting device 414 may be controlled according to the medium brightness light setting because it is located at the second location.

Additionally or alternatively, the second processors of lighting devices 412, 414 may be further arranged for receiving a second location signal indicative of a second location of a further lighting device, and the second processor may be further arranged for selecting the light setting further based on the second location of the further lighting device.

The lighting system 100 may further comprise a user interface arranged for receiving user input for defining light scenes. The lighting system may store the defined light scene in a memory. In an embodiment, the user may define light settings for two or more extreme orientations and the system may interpolate desired settings for orientations in-between those extremes. This enables a continuous control between two light settings. For example, the user may specify a desired light setting for an upward orientation and for a downward orientation. The system may then calculate interpolated light settings for all orientations in between. Various types of interpolation can be used, including for example linear or spline interpolations. The user interface may further comprise a display arranged for displaying selectable light scenes and/or for displaying the current light settings of one or more lighting devices (i.e. the current light scene). Lamp icons may be rendered on the display, which lamp icons visualize the detected orientation and associated light setting.

The second processor 114 may be further arranged for selecting the light setting further based on a type of the lighting device 112. Additionally, the first processor 104 of the first device 102 may be further arranged for generating the signal, wherein the signal further comprises a plurality of associations between types of devices, orientations and light settings. An LED strip may, for example, require different light settings compared to a light bulb, and a colored light emitting light bulb may require different light settings compared to a white light emitting light bulb.

The lighting device 112 may comprise a plurality of light sources, and the second processor may be further arranged for selecting a plurality of light settings from the plurality of light settings based on the orientation of the lighting device 112, and for controlling the plurality of light sources according to the plurality of selected light settings. The lighting device 112 may, for example, comprise a (linear) array of individually controllable light sources. This enables the lighting device to create a light effect that complements the light scene generated by the first device 102.

Figure 5:
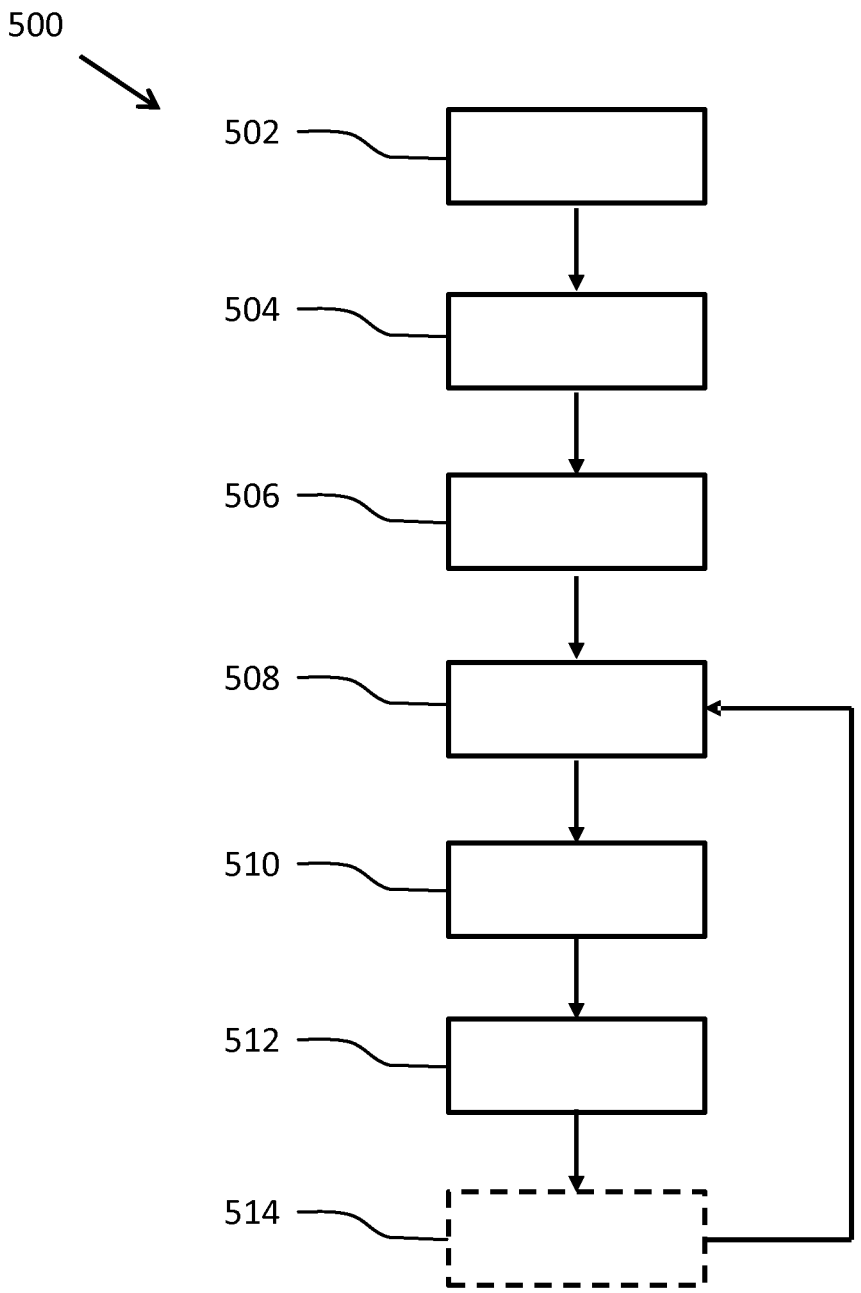
FIG. 5 shows schematically a method according to the invention for controlling a lighting device.

FIG. 5 shows schematically a method 500 according to the invention for controlling a lighting device. The method 500 comprises the steps of:

generating 502, by a first device, a signal comprising information representative of associations between a plurality of orientations and a plurality of light settings, transmitting 504 the signal, receiving 506, by the lighting device, the signal, detecting 508 a first orientation of the lighting device, selecting 510 a light setting associated with one of the plurality of orientations based on the first orientation, and controlling 512 the lighting device according to the selected light setting. Additionally, the method may comprise the step of reorienting 514 the lighting device. The reorientation may be detected 508, whereupon the steps of selecting 510 the light setting and controlling 512 the lighting device according to the selected light setting are repeated.

Figure 6:
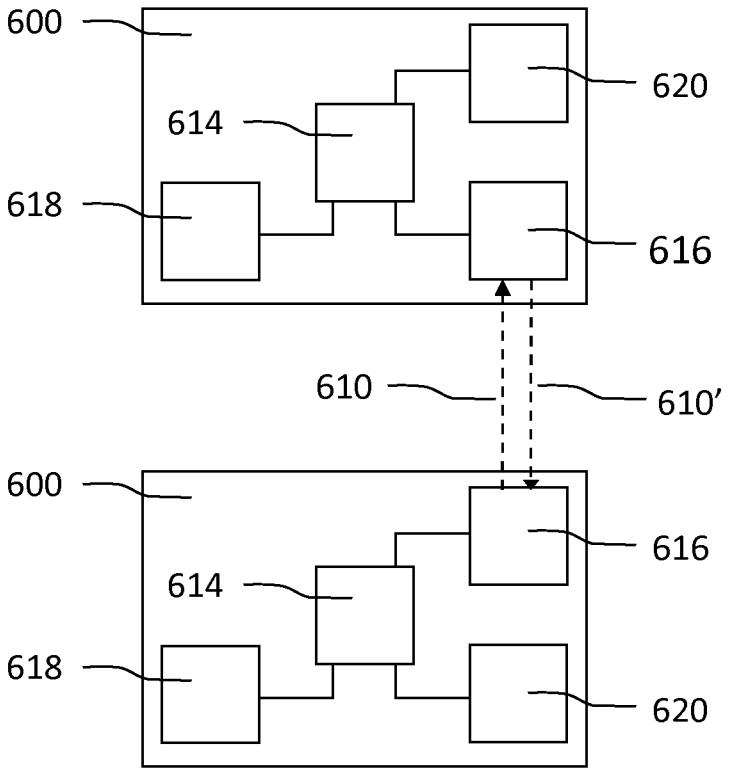
FIG. 6 shows schematically an embodiment of a lighting system according to the invention, the lighting system comprising a plurality of lighting devices arranged to be controlled according to a first mode of operation and a second mode of operation.

In embodiments, the lighting system may comprise a plurality of lighting devices, which may function either as the first device 102 or as the lighting device 112 as described in the embodiments above. Such a lighting system is illustrated in FIG. 6. Each of the plurality of lighting devices 600 comprises at least one light source 620 and an orientation detector 618 for detecting a current orientation of the lighting device 600. Each lighting device 600 further comprises a receiver 616 for receiving input signals from further lighting devices and a transmitter 616 for transmitting output signals to further lighting devices. The receiver 616 and transmitter 616 may be combined in one transceiver 616. Each lighting device further comprises a processor 614 for setting the lighting device to a master mode and/or a slave mode, wherein, when the lighting device 600 has been set to the master mode, the processor 614 is arranged for controlling the light output of the at least one light source 618 based on the current orientation, and for generating an output signal 610 comprising information representative of associations between a plurality of orientations and a plurality of light settings based on the current orientation. When the lighting device 600 has been set to the slave mode, the processor 614 is arranged for selecting, based on the current orientation, a light setting from the input signal 610', which input signal 610' comprises information representative of associations between a plurality of orientations and a plurality of light settings, and for controlling the light output of the at least one light source according to the selected light setting. The plurality of lighting devices 600 may be arranged for communicating with each other directly, via an intermediate device such as a hub or a bridge, or via further devices in, for example, a mesh-structured network. In embodiments a user may select the master/slave mode. Additionally or alternatively, the processor 614 may be arranged for setting the lighting device 600 to the master mode upon detecting a reorientation of the lighting device 600, and/or the processor 614 may be arranged for setting the lighting device 600 to the slave mode upon receiving the input signal 610'. This enables lighting devices 600 to switch between master and slave functionality, which in turn enables a user to reorient any of the lighting devices 600 to control all lighting devices 600.

Figure 7:
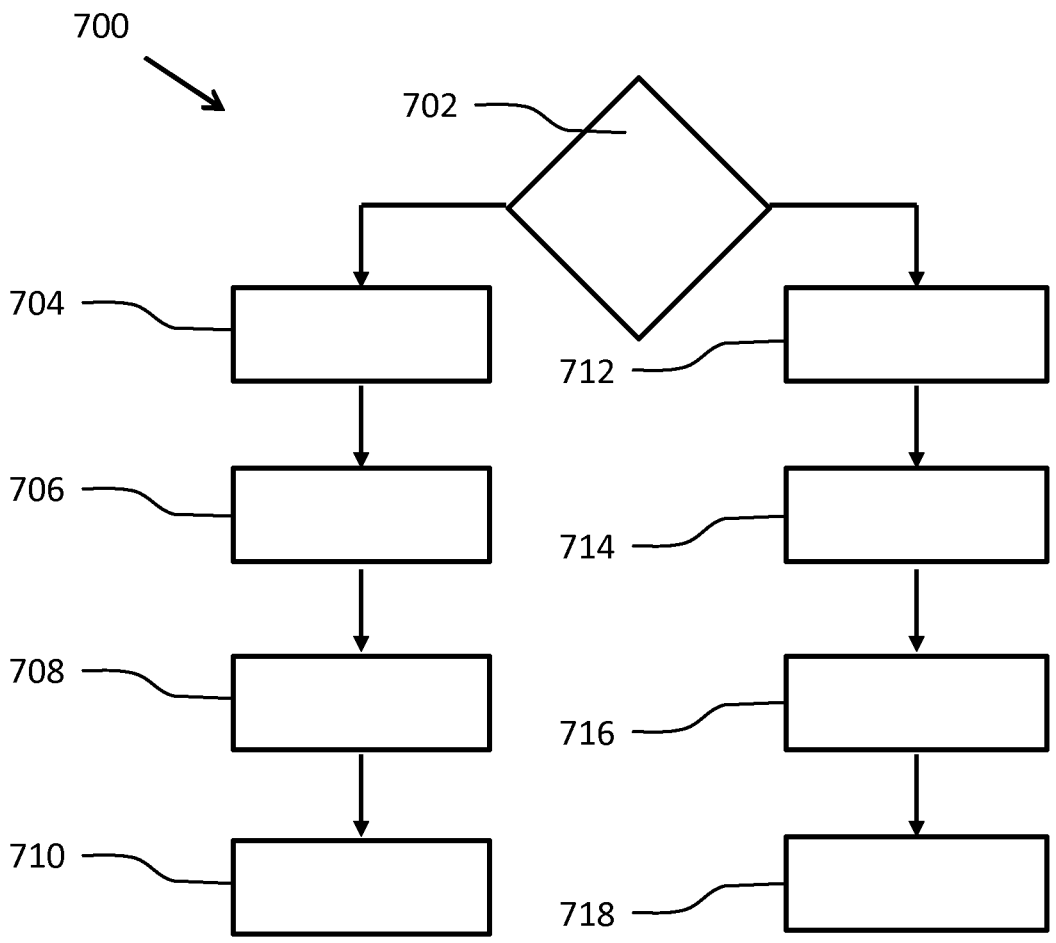
FIG. 7 shows schematically a method according to the invention for controlling a lighting device according to a first mode of operation or a second mode of operation.

Additionally or alternatively, lighting devices may be set to both a master and a slave FIG. 7 shows schematically a method 700 according to the invention for controlling a lighting device according to a first mode of operation or a second mode of operation. The method 700 comprises the steps of:

setting 702 the lighting device to a master mode or a slave mode, detecting 704 a current orientation of the lighting device, controlling 706 a light output of the lighting device based on the current orientation, generating 708 an output signal comprising information representative of associations between a plurality of orientations and a plurality of light settings based on the current orientation, transmitting 710 the output signal to a further lighting device, or receiving 712, by the lighting device, an input signal from a further lighting device, detecting 714 a current orientation of the lighting device, selecting 716, based on the current orientation, a light setting from the input signal, which input signal comprises information representative of associations between a plurality of orientations and a plurality of light settings, and controlling 718 the light output of the lighting device according to the selected light setting.

The method may further comprise the steps of:

detecting a reorientation of the lighting device 600, setting the lighting device 600 to the master mode, or receiving the input signal 610', setting the lighting device 600 to the slave mode.

It should be noted that the above-mentioned embodiments illustrate rather than limit the invention, and that those skilled in the art will be able to design many alternative embodiments without departing from the scope of the appended claims.

In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements. The invention may be implemented by means of hardware comprising several distinct elements, and by means of a suitably programmed computer or processor. In the device claim enumerating several means, several of these means may be embodied by one and the same item of hardware. The mere fact that certain measures are recited in mutually different dependent claims does not indicate that a combination of these measures cannot be used to advantage.

Aspects of the invention may be implemented in a computer program product, which may be a collection of computer program instructions stored on a computer readable storage device which may be executed by a computer. The instructions of the present invention may be in any interpretable or executable code mechanism, including but not limited to scripts, interpretable programs, dynamic link libraries (DLLs) or Java classes. The instructions can be provided as complete executable programs, partial executable programs, as modifications to existing programs (e.g. updates) or extensions for existing programs (e.g. plugins). Moreover, parts of the processing of the present invention may be distributed over multiple computers or processors.

Storage media suitable for storing computer program instructions include all forms of nonvolatile memory, including but not limited to EPROM, EEPROM and flash memory devices, magnetic disks such as the internal and external hard disk drives, removable disks and CD-ROM disks. The computer program product may be distributed on such a storage medium, or may be offered for download through HTTP, FTP, email or through a server connected to a network such as the Internet.

The invention claimed is:

1. A method of controlling a lighting device, the method comprising:

generating, by a first device, a signal comprising information representative of associations between a plurality of orientations and a plurality of light settings, transmitting the signal, receiving, by the lighting device, the signal, detecting, by an orientation detector comprised in the lighting device, a first orientation of the lighting device, selecting a light setting associated with one of the plurality of orientations based on the first orientation, and controlling the lighting device according to the selected light setting.

2. The method of claim 1, further comprising the steps of:

receiving a user input indicative of a reorientation of the lighting device, detecting, by the orientation detector, a second orientation of the lighting device, selecting a second light setting associated with one of the plurality of orientations based on the second orientation, and controlling the lighting device according to the selected second light setting.

3. The method of claim 1, wherein the associations between the plurality of orientations and the plurality of light settings are based on an orientation of the first device.

4. The method of claim 1, wherein the associations between the plurality of orientations and the plurality of light settings are based on a light output of the first device.

5. The method of claim 1, further comprising receiving a location signal indicative of a current location of the lighting device, wherein the selection of the light setting is further based on the current location of the lighting device.

6. The method of claim 1, wherein the selection of the light setting is further based on a type of the lighting device.

7. The method of claim 1, further comprising receiving a light setting signal indicative of a current light setting of a further lighting device, wherein the selection of the light setting is further based on the current light setting of the further lighting device.

8. The method of claim 7, further comprising receiving a second location signal indicative of a second location of the further lighting device, wherein the selection of the light setting is further based on the second location of the further lighting device.

9. A lighting system for controlling a lighting device, the lighting system comprising:

a first device comprising a first processor for generating a signal comprising information representative of associations between a plurality of orientations and a plurality of light settings, and a transmitter for transmitting the signal, and the lighting device comprising:

at least one light source, a receiver for receiving the signal from the first device, an orientation detector for detecting a first orientation of the lighting device, and a second processor for selecting a light setting associated with one of the plurality of orientations based on the first orientation, and for controlling the light output of the at least one light source according to the light setting.

10. The lighting system of claim 9, wherein the lighting device is arranged for receiving a user input indicative of a reorientation of the lighting device, and wherein the second processor is arranged for detecting a second orientation of the lighting device, and for selecting a second light setting associated with one of the plurality of orientations based on the second orientation, and for controlling the light output of the at least one light source according to the selected second light setting.

11. The lighting system of claim 9, wherein the first device comprises a second orientation detector for detecting a second orientation of the first device, and wherein the first processor is further arranged for generating the signal based on the second orientation of the first device.

12. The lighting system of claim 9, wherein the first device comprises a light source for emitting light, and wherein the first processor is further arranged for generating the signal based on the light output of the light source of the first device.

13. The lighting system of claim 9, wherein the second processor is further arranged for receiving a location signal indicative of a current location of the lighting device, and for selecting the light setting further based on the current location of the lighting device.

14. The lighting system of claim 9, wherein the second processor is further arranged for receiving a light setting signal indicative of a current light setting of a further lighting device, and for selecting the light setting further based on the current light setting of the further lighting device.

15. A lighting device comprising:

at least one light source, an orientation detector for detecting a current orientation of the lighting device, a receiver for receiving input signals from further lighting devices, a transmitter for transmitting output signals to further lighting devices, and a processor for setting the lighting device to at least one of a master mode and a slave mode, wherein, when the lighting device has been set to the master mode, the processor is arranged for controlling the light output of the at least one light source based on the current orientation, and for generating an output signal comprising information representative of associations between a plurality of orientations and a plurality of light settings based on the current orientation, and wherein, when the lighting device has been set to the slave mode, the processor is arranged for selecting, based on the current orientation, a light setting from the input signal, which input signal comprises information representative of associations between a plurality of orientations and a plurality of light settings, and for controlling the light output of the at least one light source according to the selected light setting.

* * * * *